US006915914B2

(12) United States Patent
Farrand

(10) Patent No.: US 6,915,914 B2
(45) Date of Patent: Jul. 12, 2005

(54) THEFT DETERRENT DISPLAY AND STORAGE SYSTEM

(76) Inventor: Todd Anthony Farrand, 28751 El Mio La., Mission Viejo, CA (US) 92692

( * ) Notice: Subject to any disclaimer, the term of this patent is extended or adjusted under 35 U.S.C. 154(b) by 20 days.

(21) Appl. No.: 10/392,046

(22) Filed: Mar. 18, 2003

(65) Prior Publication Data

US 2004/0182811 A1 Sep. 23, 2004

(51) Int. Cl.[7] ..... A47F 5/00

(52) U.S. Cl. ..... 211/163; 211/56; 211/58; 312/125; 312/321.5

(58) Field of Search ..... 312/321.5, 125, 312/135; 211/4, 163, 56, 58, 131.1

(56) References Cited

U.S. PATENT DOCUMENTS

| | | | | | |
|---|---|---|---|---|---|
| 234,461 | A | * | 11/1880 | Dodge | 312/249.6 |
| 1,214,676 | A | * | 2/1917 | Herzog | 312/305 |
| 3,868,157 | A | * | 2/1975 | Robinson | 312/305 |
| 4,179,168 | A | * | 12/1979 | Isaac et al. | 312/125 |
| 4,850,658 | A | * | 7/1989 | Sandor | 312/225 |
| 5,494,347 | A | * | 2/1996 | Poortvliet et al. | 312/270.2 |
| 5,547,273 | A | * | 8/1996 | Hudnall | 312/305 |
| 5,820,238 | A | * | 10/1998 | Lambright | 312/291 |
| D437,509 | S | * | 2/2001 | Eustace | D6/445 |
| 2002/0000417 | A1 | * | 1/2002 | Kidd et al. | 211/85.1 |

* cited by examiner

*Primary Examiner*—Robert W. Gibson, Jr.
(74) *Attorney, Agent, or Firm*—Pyle & Piontek

(57) ABSTRACT

The present invention is a display rack for goods and is primarily a wire formed structure that also employs channel rod as well as formed plastic top and bottom cap structures. In the preferred embodiment there exists a central rectangular frame structure having a base and extending upward there from to a top end portion. Each of the four sides of the central structure includes a rotating wall or door wherein each door includes a front retail side surface for retaining goods thereon and an opposite blocking paneled surface. The doors can be locked into either the retail or blocked position. Four carousels are also secured to and form an integral part of each of the four corners of the central frame. The carousels each have columns for retaining goods and one flat blocking panel column, all positioned vertically and symmetrically around each carousel perimeter. Each carousel can be locked into a gods blocking position or be unlocked and free to rotate.

5 Claims, 10 Drawing Sheets

10
15
24
22
32
28
27
27a
24a
34
40
38a
12c
12
36
38
32
28
24
24a 60
62
36
36
34
64

THEFT DETERRENT DISPLAY AND STORAGE SYSTEM

FIELD OF THE INVENTION

The present invention relates generally to display racks for retail goods, and in particular to display racks that provide for securing the goods from theft and especially so during non retail hours.

BACKGROUND

Various racks are known and used in retail business to attractively and conveniently display goods for sale. Such racks provide various means for retaining a plurality of similar or dissimilar goods in an orderly and eye pleasing fashion that also allows the consumer to readily select and remove there from the particular good of choice. Various means are used in these retail displays, such as, wire hang pegs and wire formed baskets or shelves, which are well suited to this purpose. It is also known to employ various strategies to move the goods forward as each individual good is selected and removed. Such facing-up is accomplished, for example, by biasing structures employing spring mechanisms or simply through the use of gravity wherein a shelf or similar structure is inclined in a downward direction towards the front of the retail display. By facing the goods continually towards the front, it is easier for the consumer to make a selection and take the individual good of choice, and it better enables shop keepers to see when a particular product needs to be re-stocked.

While the convenience of the customer is paramount, and greatly influences display form and function, as generally described above, a growing concern is the loss of goods due to theft. To the added dismay of retail business owners is the fact that, for many products, the majority of theft loss is due to their employees, rather than the public at large. Accordingly, it would be desirable to have a display rack that provides for the retail display and sale of products that is, in addition to aesthetically pleasing and convenient for both the consumer and the retail location owner, also provides for secure retention of the goods after store hours in order that employee theft is greatly reduced or eliminated.

SUMMARY OF THE INVENTION

The present invention is a display rack for goods, and in the illustrative example shown herein, designed for the retail display of music or movie recorded media and in particular, CD's, DVD's or video tapes. The display herein is primarily a wire formed structure that also employs channel rod as well as formed plastic top and bottom cap structures. In the preferred embodiment there exists a central rectangular frame structure having a base and extending upward there from approximately five feet. Each of the four sides of the central structure includes a rotating wall or door wherein each door includes a front retail side surface and an opposite paneled side surface. The front surfaces thereof each include a symmetrical array of columns of wire formed baskets. Each basket is capable of retaining a predetermined number of recorded media goods in a slightly downwardly angled manner. Each door is pivotally secured at the center thereof to the display base support portion and to a display top end support portion. The central frame structure and the doors thereof are sized so that each door can be individually rotated 360 degrees about its pivotal mounting so that either the goods are presented forward or the flat panel is facing forward. The doors can be locked into either position.

The preferred embodiment also includes four carousels secured to and forming an integral part of each of the four corners of the central frame. Each carousel is centrally and pivotally secured to extensions of the frame bottom and top end support portions. The carousels each have three columns for retaining goods and one flat panel column positioned vertically and symmetrically around their perimeters. Each carousel rotates 360 degrees within its own housing wherein each housing has a vertical opening sufficient to permit display of and access to the goods of one of the three goods display columns at a time or is closed completely when the flat panel thereof is registered there with. Each carousel can be locked into the panel registered position or be unlocked and free to rotate.

In operation, it can be understood that the four rotatable doors can be positioned and secured in place to either present goods for retail sale or can present the paneled side. Thus, with each door locked in the panel forward position, all of the goods face inwardly of the central frame and are inaccessible to selection and removal. Likewise, when each of the carousels is locked in the panel forward/opening registered position, the goods retained thereon are similarly inaccessible.

DESCRIPTION OF THE DRAWINGS

A better understanding of the construction and operation of the present invention as well as the objects and advantages thereof can be had by reference to the following detailed description which refers to the following figures, wherein.

DETAILED DESCRIPTION OF THE PREFERRED EMBODIMENT

Figure 1:
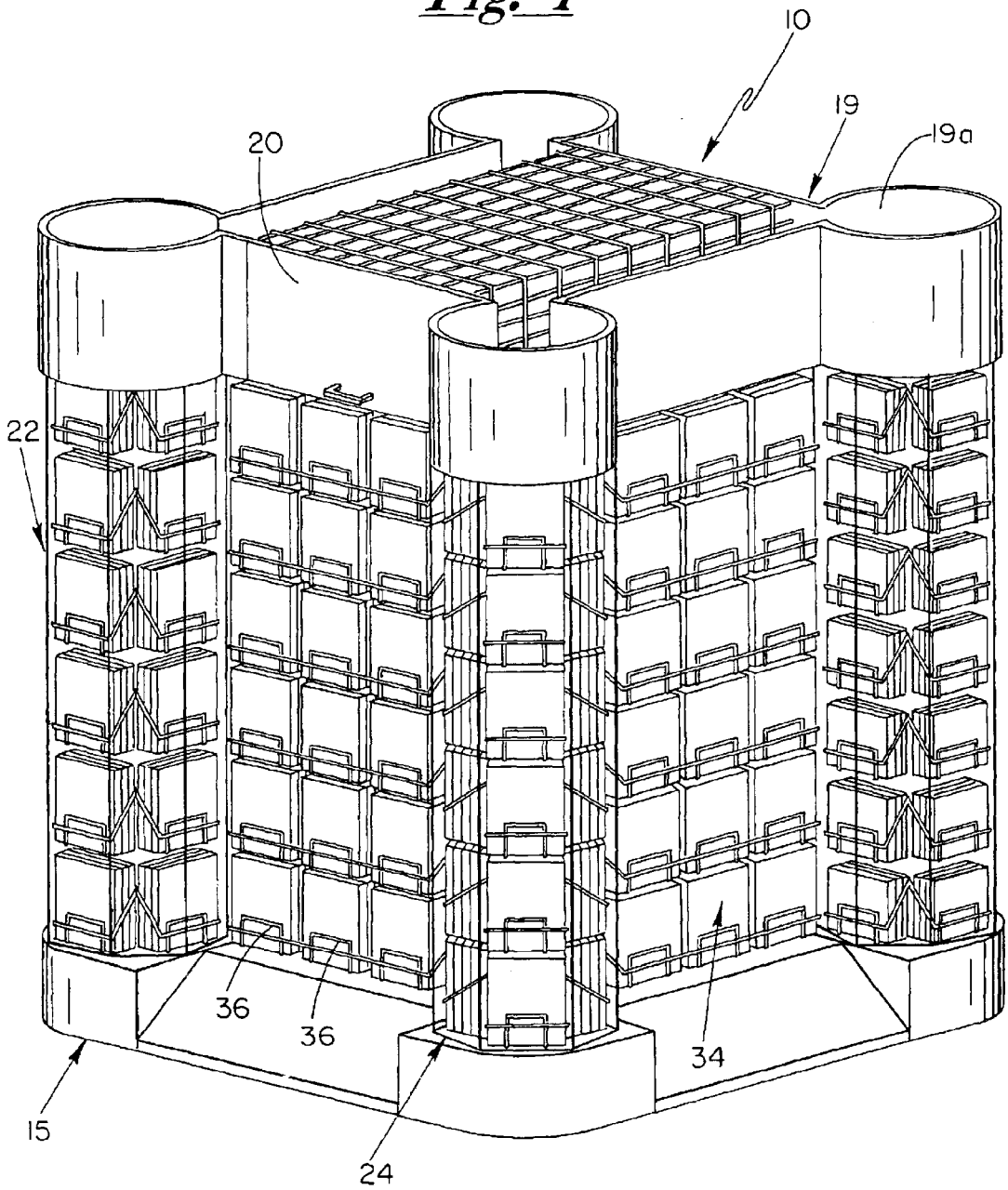
FIG. 1 shows a perspective view of the present invention.
Figure 2:
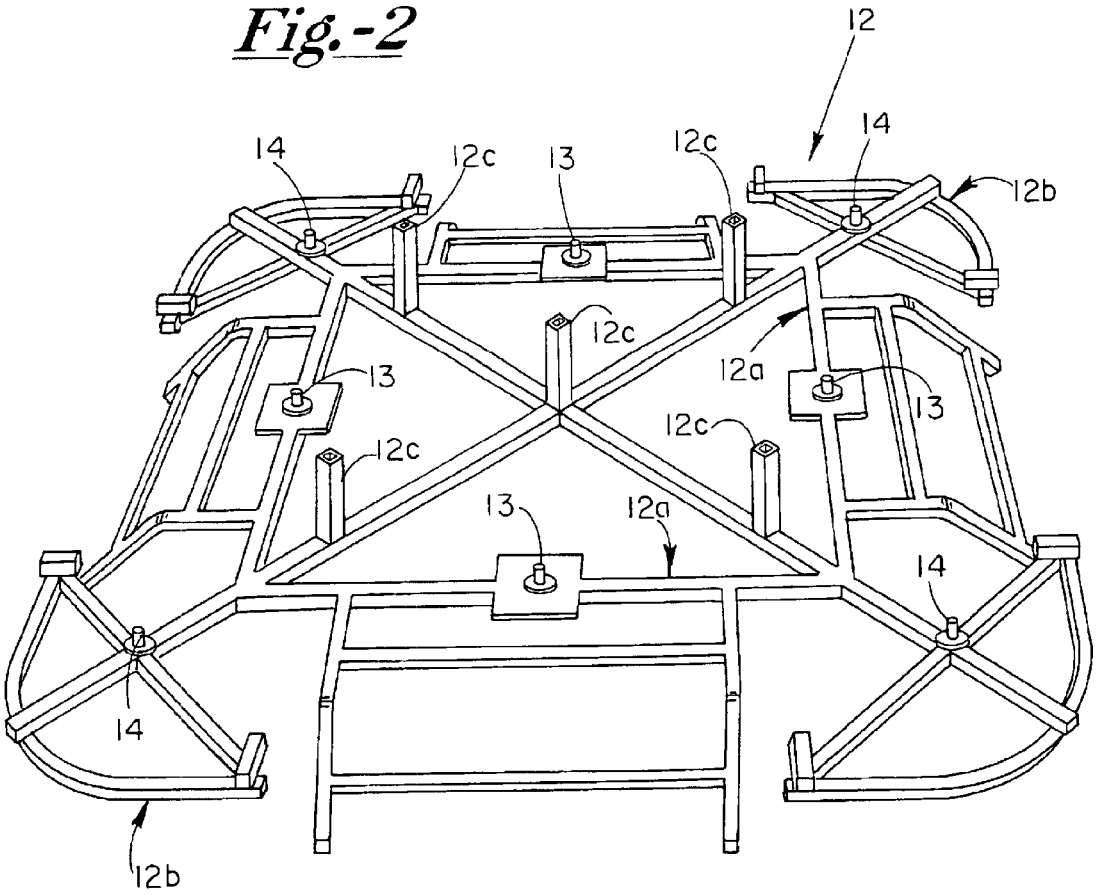
FIG. 2 shows a perspective view of the bottom frame support portion thereof.
Figure 3:
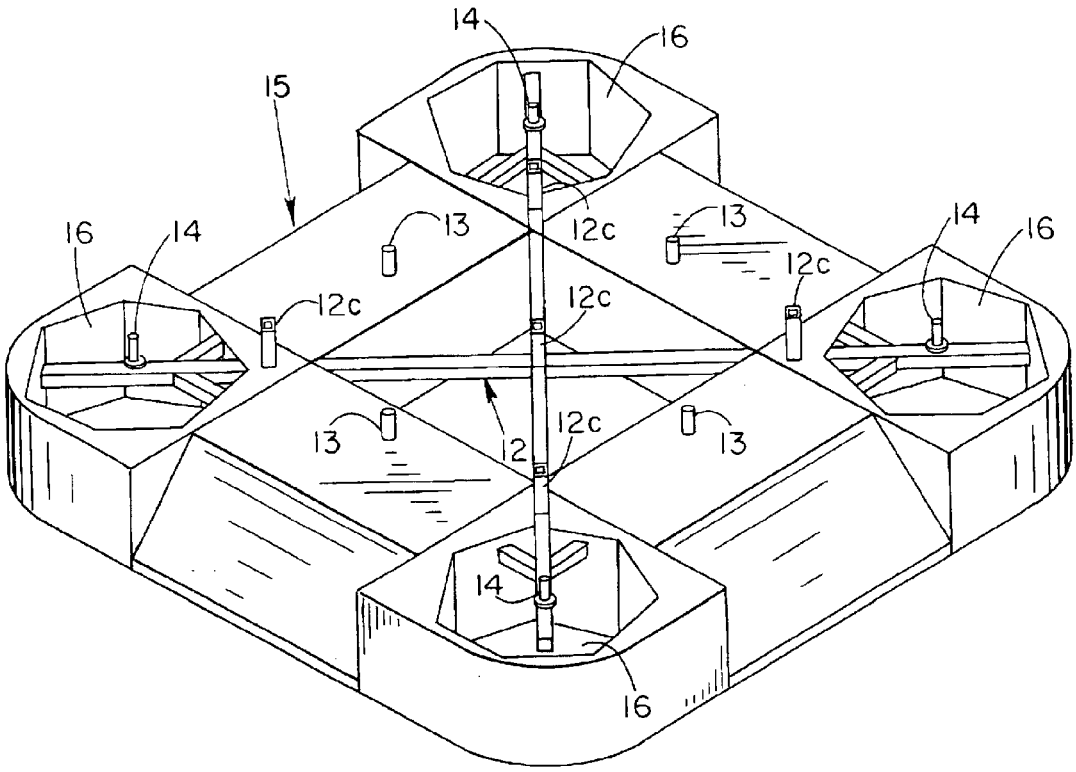
FIG. 3 shows a perspective view of the bottom frame support portion with the bottom cap structure thereon.
Figure 5:
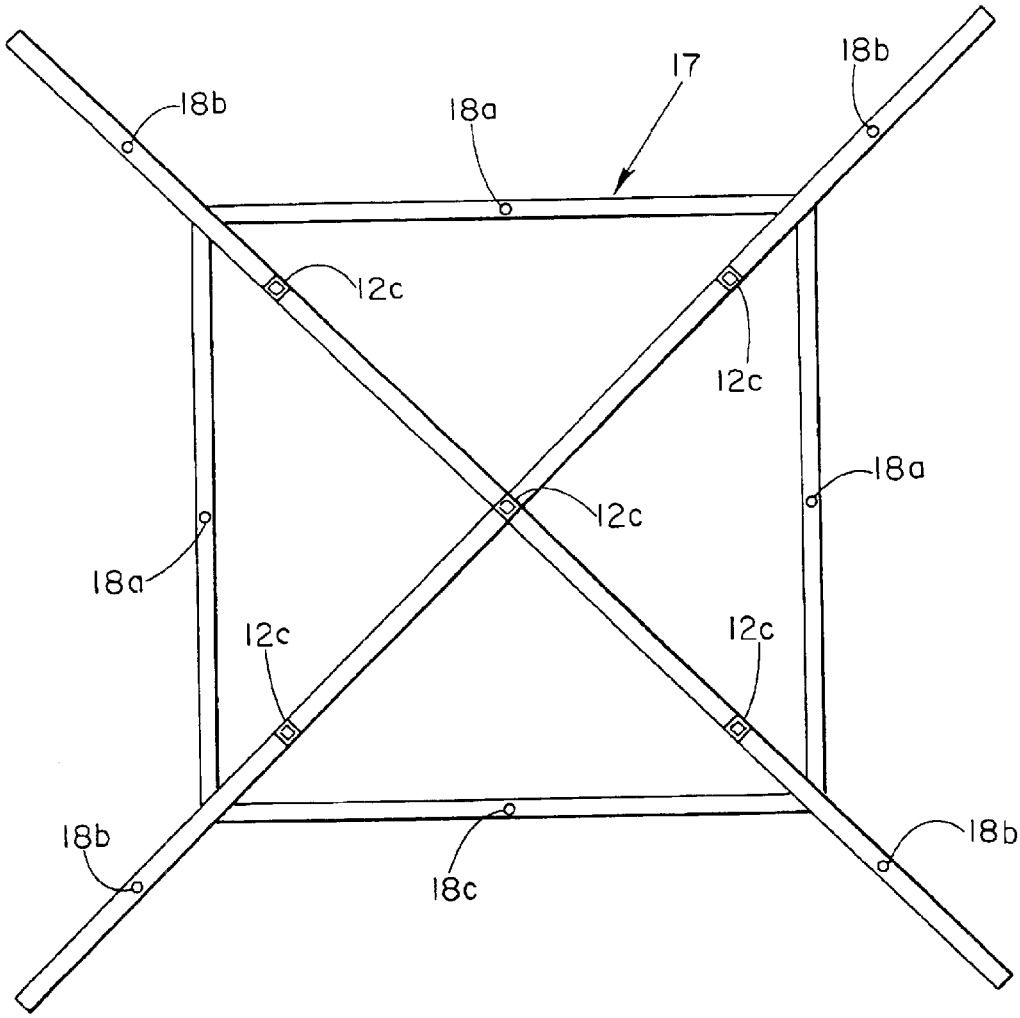
FIG. 5 shows a plan view of a top frame portion.
Figure 6A:
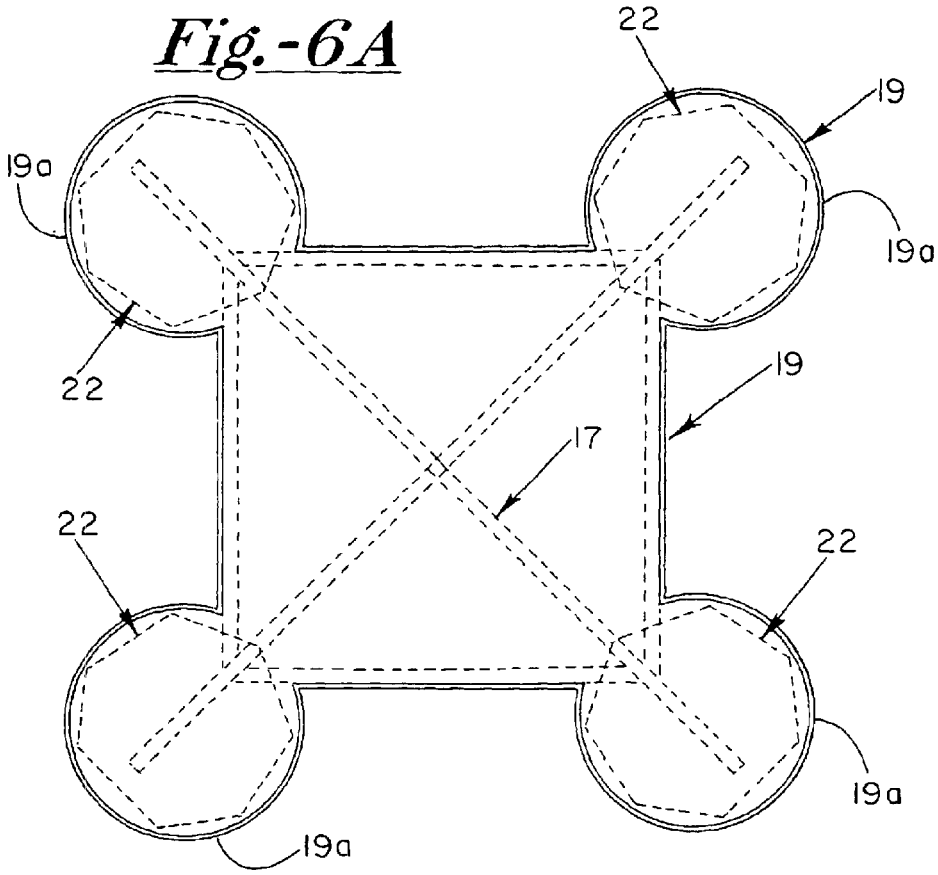
FIG. 6A shows a perspective view of the top cap structure.
Figure 6B:
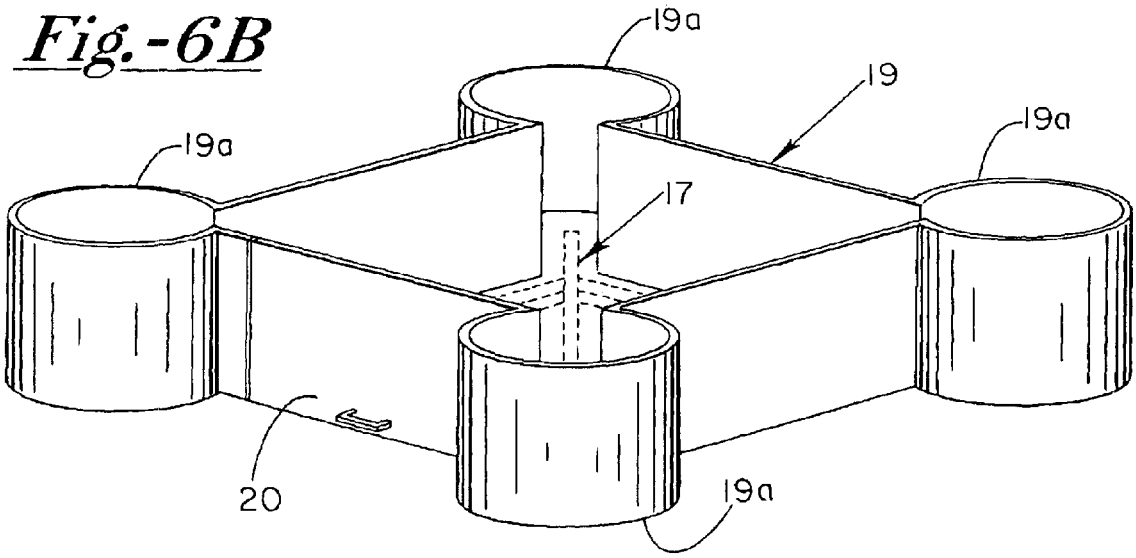
FIG. 6B shows a bottom plan view along lines 5B—5B of FIG. 5A

The display device of the present invention is seen in FIG. 1 and generally referred to by the numeral 10. Display 10, in the illustrative embodiment thereof, is specifically designed for the retail display of music or movie recorded media and in particular, CD's, DVD's or video tapes. Of course, those of skill will understand that the present invention can easily be designed to display a wide variety of retail goods. As seen in FIG. 2, display 10 employs structural channel rod to for a base frame structure 12. Framework 12 includes a central door support portion 12*a* and four carousel support portions 12*b*. Central support portion 12*a* includes four door pivot pins 13 and each carousel frame portion 12*b* includes a carousel pivot support 14. Frame 12 also includes five vertical frame members 12*c*. As seen in FIG. 3, a molded plastic bottom cap 15 is sized to fit over frame 12. Bottom cap 15 includes four heptagonal carousel housing receiving openings 16. A top frame member 17 is seen in FIG. 5 and includes four door pivot pins 18*a* and four carousel pivot pins 18*b*. Top frame member 17 is secured at a desired height above base frame 12 by the vertical framework support members 12. A top cap 19 is seen in FIGS. 6A and 6A and provides for a decorative cover over top frame member 19 and includes four carousel top lobes 19*a*. Top cap 19 also includes a lockable door 20.

Figure 4A:
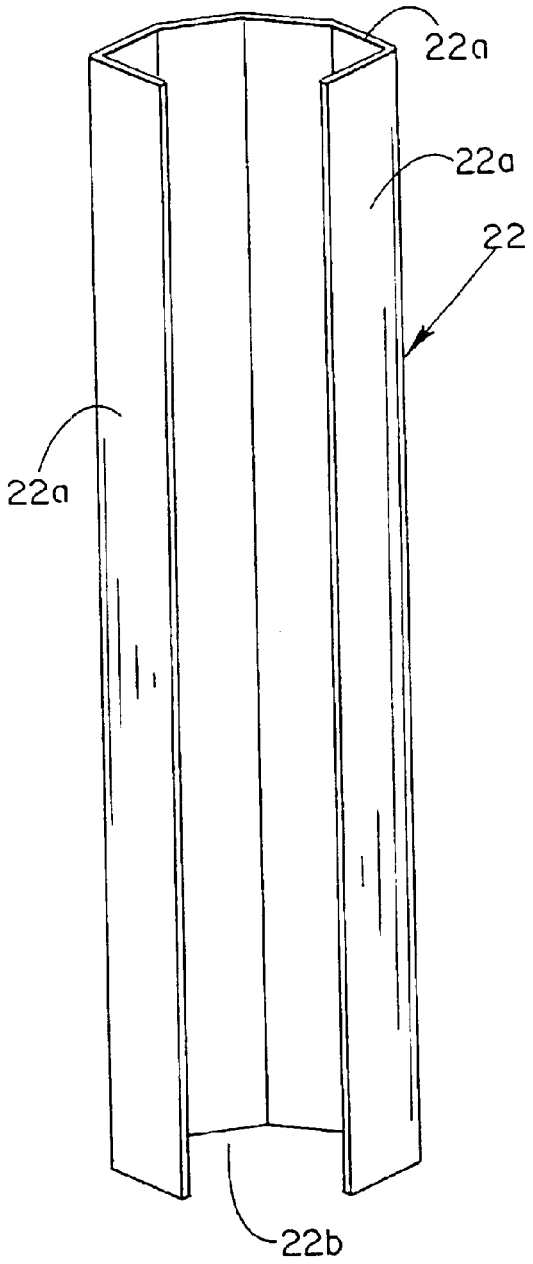
FIG. 4A shows a perspective view of one of the carousel housings.
Figure 4B:
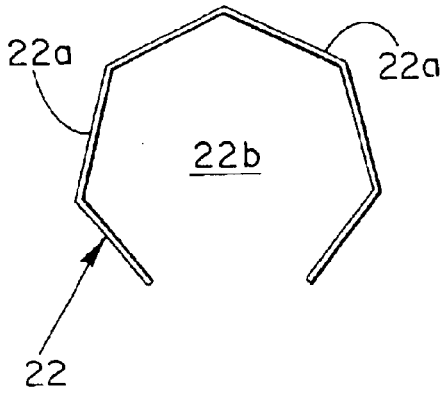
FIG. 4B shows a top plan view along lines 4B—4B of FIG. 4A.

As seen in FIGS. 4A and 4B an individual carousel housing 22 is shown and can be made of a suitably rigid transparent or translucent plastic material. Housing 22 is formed into a heptagonal cylindrical shape having six perimeter sides 22*a* with a seventh "side" comprising an opening 22*b*. It will be appreciated that housings 22 are formed to be firmly received in openings 16 of base cap 15 and are also inserted and retained within lobes 19*a* of top cap 19.

Figure 7:
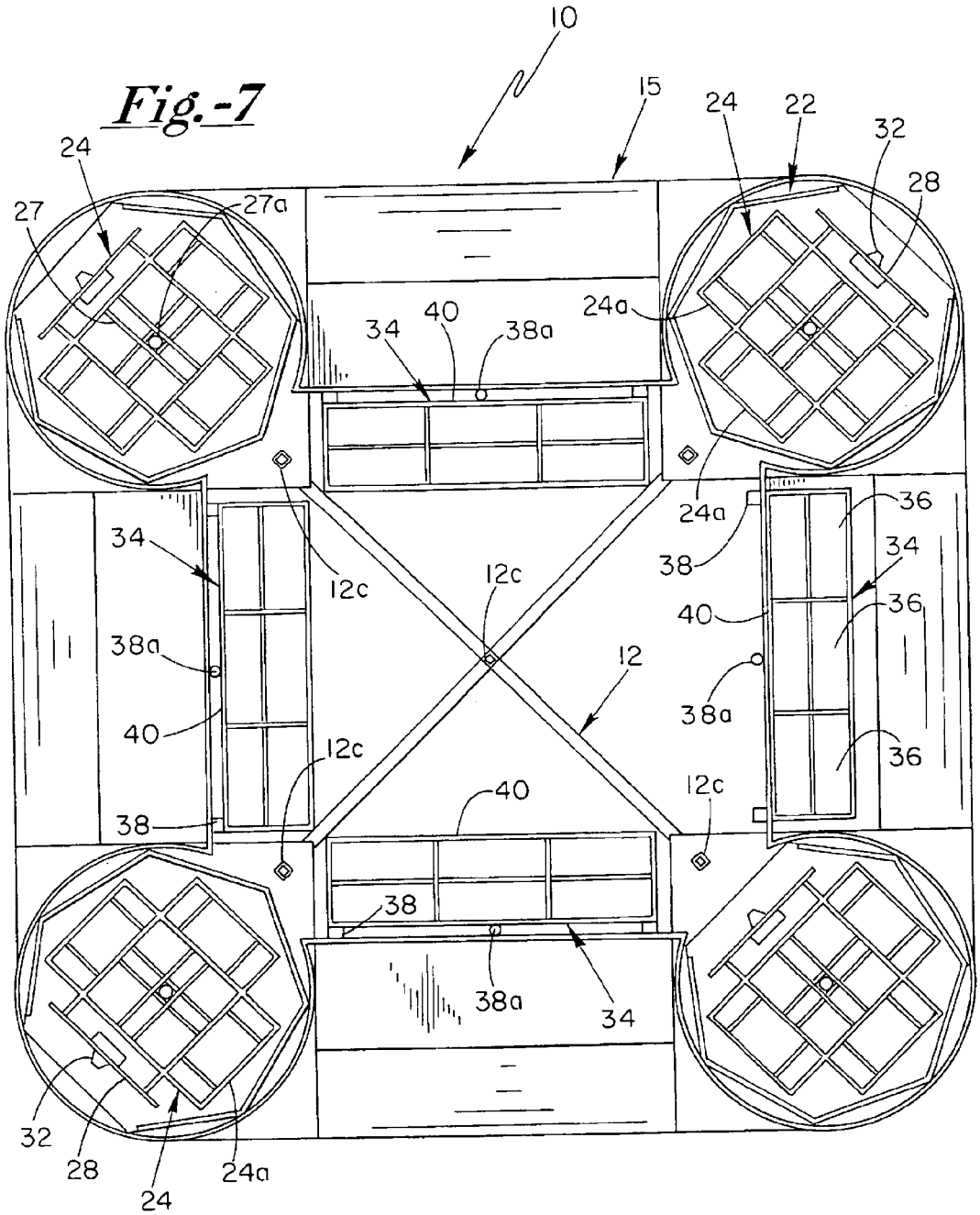
FIG. 7 shows a top plan cross-sectional view along lines 6—6 of FIG. 1.

As seen by referring to FIG. 7, each display 10 includes four wire formed carousels 24. Carousels 24 each include a plurality of goods retaining baskets 24*a* that are arranged vertically in three vertical columns 26 each secured to a central frame 27 having a central support tube 27*a*. A fourth column consists of a blocking panel 28 secured to frame 27. Each panel 28 is secured to a top locking plate 28. Locking plates 28 each include a keyed locking mechanism 32. Each Carousel 24 is vertically and pivotally mounted to corresponding upper pivot pins 14 and lower pivot pins 18*b* and retained within carousel housings 22, which housings 22 are, in turn, positioned between top cap 19 and bottom cap 15.

Display 10 also includes four central revolving doors 34. Each door 34 includes a plurality of wire formed goods retaining baskets 36 arranged in horizontal rows along a retail side thereof and secured to a door frame 38. Frame 38 includes a central rigid tube for providing pivotal mounting of each door 24 to corresponding pins 13 and 18*a*. Each door also includes a panel 40 secured to frame 38 on the side thereof opposite from baskets 36 and includes a keyed lock mechanism 42.

A wired formed goods retaining cage 44 is secured to top frame 19 and is accessible only through door 20.

Figure 8:
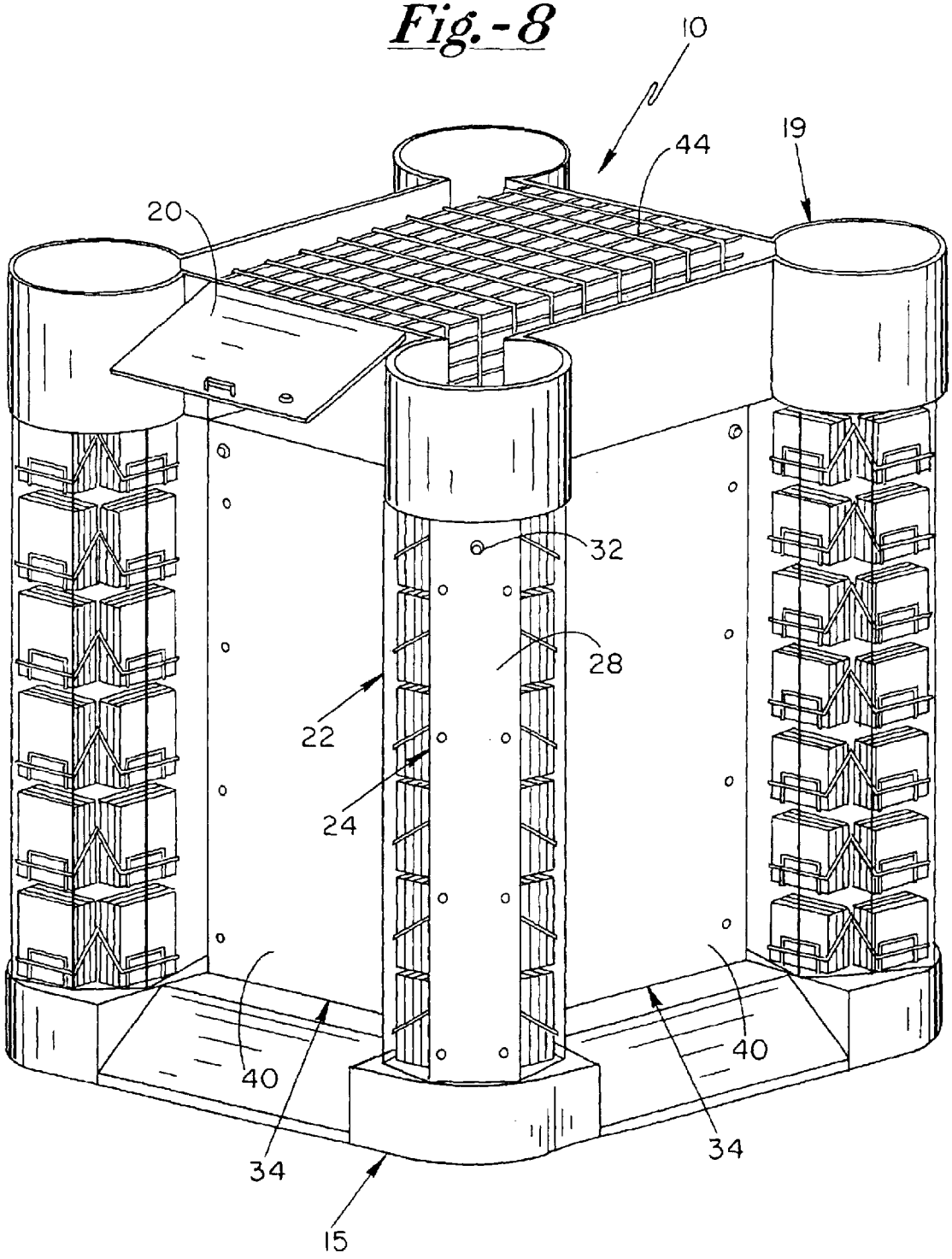
FIG. 8 shows a further perspective view of the present invention with the display carousels and doors in their locked positions.

In operation, and as seen by further referring to FIG. 8, it can be understood that the four rotatable doors 34 can be rotated to a sales or locked up position. In the sales position, seen in FIG. 1, the goods retaining baskets thereof are faced outward for permitting customer access thereto. In the Locked position, seen for example in FIG. 8, each door 34 is rotated so that the panel 40 faces outward and each door is locked in that position to prevent access to the goods. It can also be appreciated that carousels 24 each operate in the same manner. The locked position thereof is seen for example in FIG. 8 wherein each carousel 24 is rotated so that the panels 28 thereof register with the carousel housing openings 22*b*. Carousels 24 are then locked in that position to prevent access to the goods retained thereon. When not so locked, carousels 24 are free to be rotated by the retail customer in order to permit selection of the desired good. When goods on doors 34 or carousels 24 become depleted such can be restocked with goods securely retained within cage 44.

It will be appreciated by those of skill that the above described locking procedure of the carousels 24 and doors 34 is ideally performed just at the close of business hours by a designated person or persons. Naturally, an employee could take a good from the display during store retail hours, however, most employee theft is done after the close of the business when there is less visibility to other employees, to the public and where surveillance cameras may have been shut down. Best practice would have the retail owner or other, such as a trusted manager, have the responsibility for the locking of the display. Clearly other procedures could be used in conjunction with the present invention, such as, having a count of the items at opening and at close combined with a means of knowing total inventory as well as number of goods sold. It is well recognized that most any security device or system can be compromised. However, the employee theft of items such as blank or recorded audio or video media and items of similar value, results from an opportunity to easily take the goods combined with there being very little or no chance of being caught. However, the display of the present invention provides a significant barrier to employee theft by reducing the time available to steal, as well as the number of people with a good opportunity to do so, and significantly increases the risk of being detected.

Figure 9A:
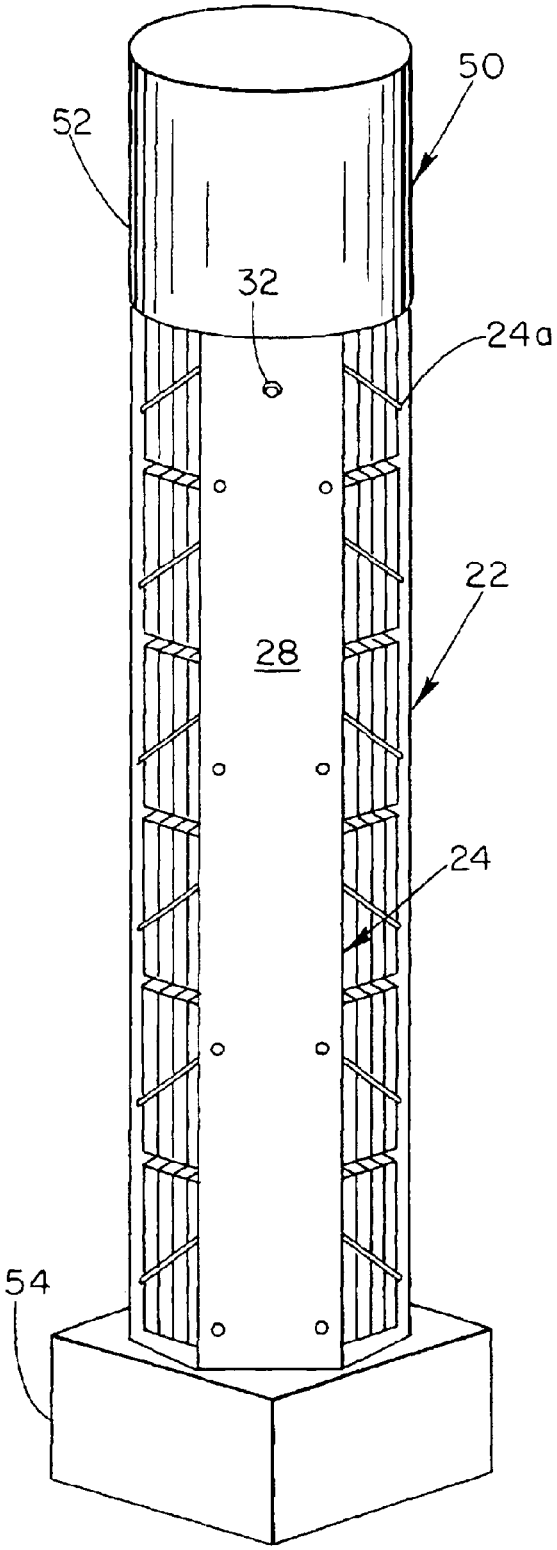
FIG. 9A shows a perspective view of an alternate embodiment of the present invention consisting of one carousel in a locked position.
Figure 9B:
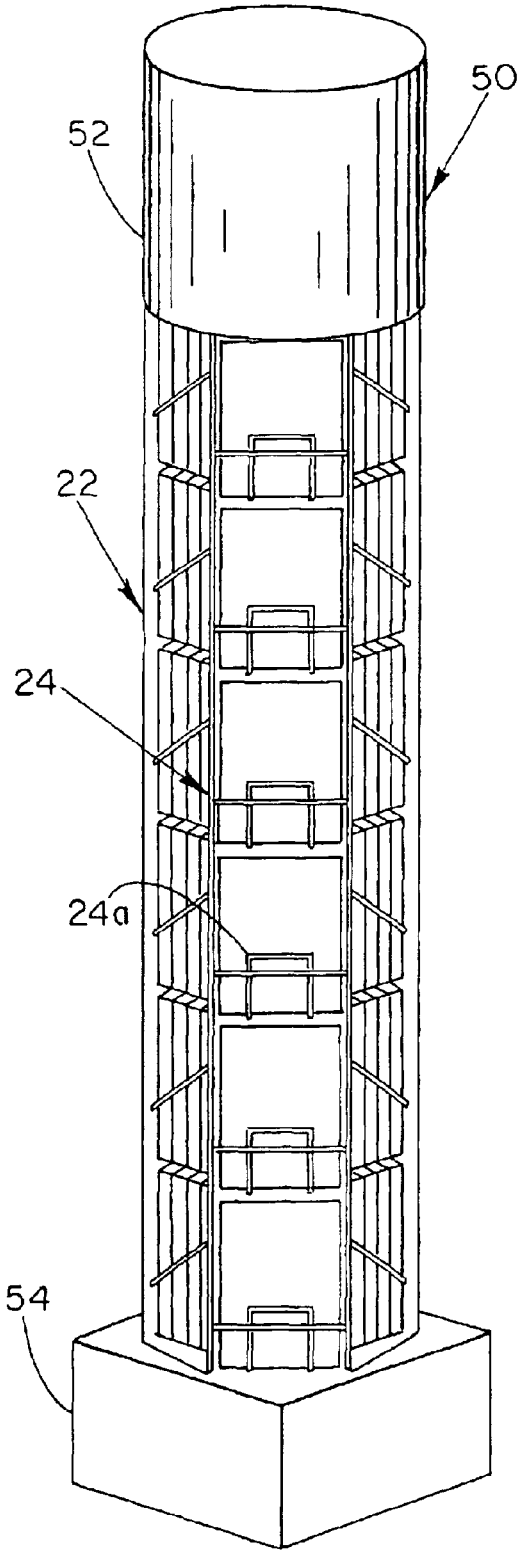
FIG. 9B shows a perspective view of the embodiment of FIG. 8A in an open position.

It will be apparent to persons of skill that various changes or modifications to the present invention can be had that remain within the spirit and scope thereof For example, an embodiment 50, as seen in FIGS. 9A and 9B, consists of a single carousel 24 pivotally mounted between a top cap 52 and base structure 54. Clearly, carousel 24 thereof could include a different number of goods retaining columns thereon so long as it could be rotated to a locked position wherein a panel side thereof is presented to register with a correspondingly sized opening of an outer housing so that access to the goods on the \carousel is prevented.

Figure 10:
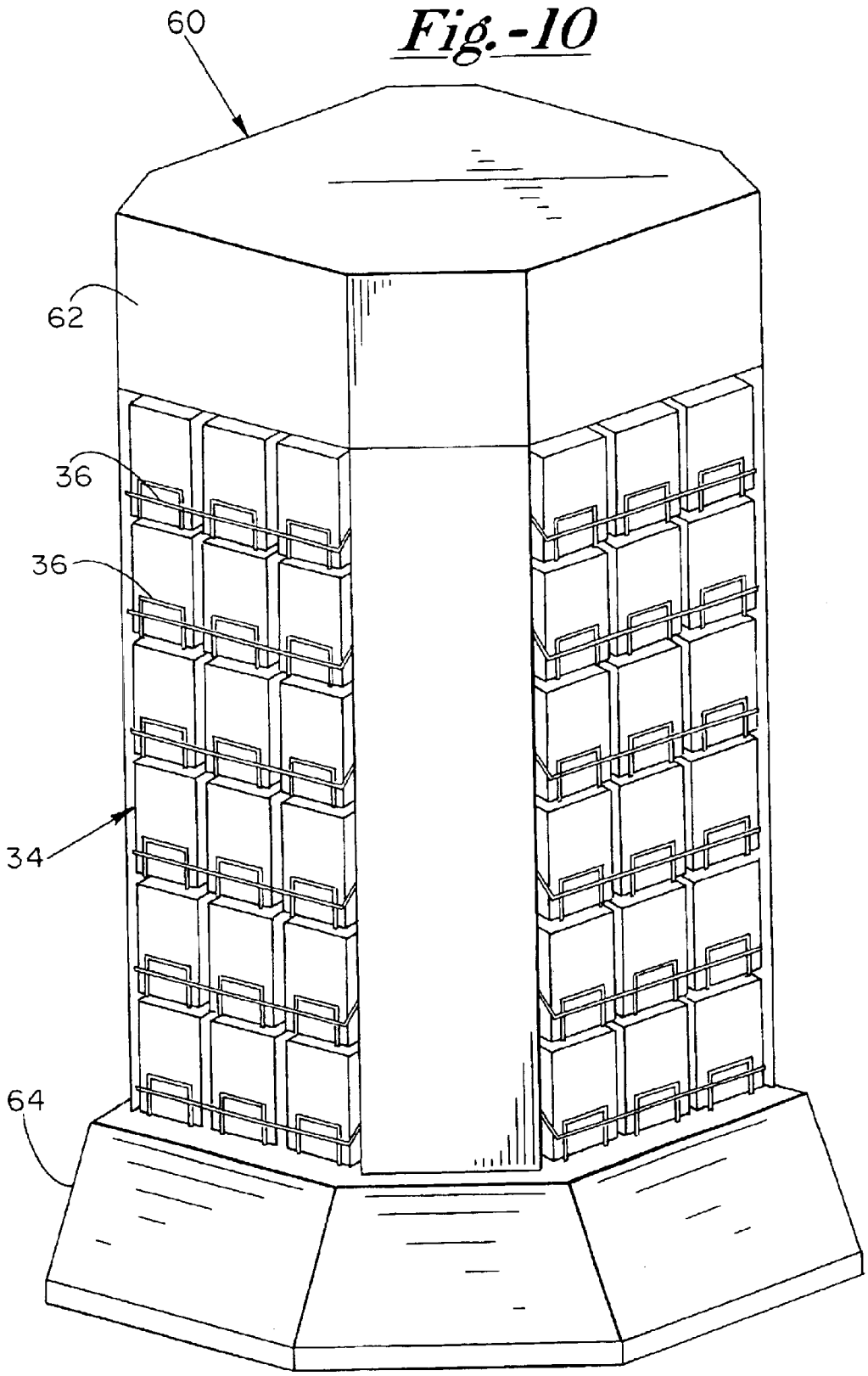
FIG. 10 shows a perspective view of a further embodiment of the present invention.

A further embodiment 60, as seen in FIG. 10, can be successfully used wherein there can exist one or more revolving doors 34 in a retaining structure having a top cap 62 and a base 64. Thus, various embodiments can be understood to have any number of sides each having one or more revolving doors 34. In fact, embodiment 60 could take on any number of perimeter geometric shapes, such as, triangular, hexagonal, etc. or could be round or even irregular in perimeter shape so long as when each door 34 is rotated and put into the locked position, an outward facing panel or the like serves to prevent access to the goods held thereon. Likewise, various other changes and modifications to the present invention can be had that will be understood by those of skill to also have an aesthetic or functional aspect or impact, but that will not exceed the spirit and scope of the present invention. For example, panels 28 and 40 and top and bottom caps 19 and 15 can consist of an opaque plastic whereas carousel housings 22 can preferably consist of a clear or translucent plastic.

What is claimed is:

1. A display device, comprising:

a vertically extending support frame, one or more doors pivotally secured to the support frame between bottom and top end portions thereof and the one or more doors each having a first side for holding and displaying a plurality of goods thereon and an opposite non-goods retaining side, and the one or more doors each moveable to a first position wherein the goods are presented for removal from the first side and where each one or more doors are also movable to a second locked position wherein the opposite side thereof is presented whereby the goods on the first side are not accessible for removal therefrom, and further including one or more carousel structures integral with the support frame, each one or more carousel structures having a carousel housing and the carousel housing defining a vertically extending housing opening, and the carousel structure having a vertically extending carousel pivotally mounted within the carousel housing and each one or more carousel having one or more goods retaining columns for retaining a plurality of the goods thereon and having a blocking column having a panel extending vertically there along and secured thereto, and the carousel movable to a plurality of positions wherein the one or more goods retaining columns register with the housing opening so that the goods thereon are accessible and removable therefrom and each carousel moveable to a locked position wherein the vertically extending panel of the blocking column registers with the housing opening so that the goods on the goods retaining columns are not accessible for removal therefrom.

2. A display device, comprising:

a vertically extending support frame;

at least one vertically extending article holder secured to said support frame between bottom and top end portions of said support frame; and at least one carousel structure secured to said support frame, each said at least one carousel structure having a carousel housing defining a housing opening and a carousel rotatably mounted in said carousel housing, each said carousel having an article retainer and a blocking panel and being rotatable in its carousel housing to a position wherein said article retainer registers with said opening of its housing so that retained articles are accessible and to a position wherein its blocking panel registers with said opening of its housing so that articles on its article retainer are not accessible.

3. A display device, comprising:

a support frame;

at least one article holder secured to said support frame; and at least one carousel structure attached to said support frame, each said at least one carousel structure having a carousel housing defining a housing opening and a carousel rotatably carried in said carousel housing, each said carousel having at least one article retainer and a blocking panel and being rotatable in its carousel housing to a position where its at least one article retainer is at its housing opening to permit access thereto through its housing opening and to a position where its blocking panel is at its housing opening so that its at least one article retainer is not accessible through its housing opening.

4. A display device as in claim 3, wherein said at least one article holder comprises a plurality of article holders and said at least one carousel structure comprises a plurality of carousel structures.

5. A display device as in claim 4, wherein individual ones of each of said plurality pf article holders and said plurality of carousel structures are positioned in alternate relationship around said support frame.

* * * * *